United States Patent [19]

Ogawa et al.

[11] 4,452,875

[45] Jun. 5, 1984

[54] AMORPHOUS PHOTOCONDUCTIVE MEMBER WITH α-SI INTERLAYERS

[75] Inventors: Kyosuke Ogawa, Sakurashin; Shigeru Shirai, Yamato; Junichiro Kanbe, Yokohama; Keishi Saitoh, Tokyo; Yoichi Osato, Yokohama; Teruo Misumi, Kawasaki, all of Japan

[73] Assignee: Canon Kabushiki Kaisha, Tokyo, Japan

[21] Appl. No.: 464,881

[22] Filed: Feb. 8, 1983

[30] Foreign Application Priority Data

| | | | |
|---|---|---|---|
| Feb. 15, 1982 | [JP] | Japan | 57-22417 |
| Feb. 15, 1982 | [JP] | Japan | 57-22418 |
| Feb. 15, 1982 | [JP] | Japan | 57-22419 |
| Mar. 2, 1982 | [JP] | Japan | 57-33501 |
| Mar. 2, 1982 | [JP] | Japan | 57-33502 |
| Mar. 2, 1982 | [JP] | Japan | 57-33503 |

[51] Int. Cl.[3] ..... G03G 5/082; G03G 5/14

[52] U.S. Cl. ..... 430/57; 430/60; 430/63; 430/65; 252/501.1; 427/74; 357/2

[58] Field of Search ..... 430/57, 60, 63, 65; 252/501.1; 427/74; 357/2

[56] References Cited

U.S. PATENT DOCUMENTS

| | | | |
|---|---|---|---|
| 3,210,184 | 10/1965 | Uhlig | 430/65 |
| 4,217,374 | 8/1980 | Ovshinsky et al. | 430/84 X |
| 4,226,898 | 10/1980 | Ovshinsky et al. | 430/84 X |
| 4,251,289 | 2/1981 | Moustakas et al. | 204/192 P |
| 4,253,882 | 3/1981 | Dalal | 427/74 X |
| 4,265,991 | 5/1981 | Hirai et al. | 430/65 X |
| 4,289,822 | 9/1981 | Shimada et al. | 427/74 X |
| 4,378,417 | 3/1983 | Marayama et al. | 430/57 |
| 4,394,426 | 7/1983 | Shimiza et al. | 430/65 |
| 4,409,308 | 10/1983 | Shimiza et al. | 430/60 |

FOREIGN PATENT DOCUMENTS

| | | | |
|---|---|---|---|
| 56-25743 | 3/1981 | Japan | 430/57 |
| 56-64347 | 6/1981 | Japan | 430/57 |

*Primary Examiner*—Roland E. Martin, Jr.

*Attorney, Agent, or Firm*—Fitzpatrick, Cella, Harper & Scinto

[57] ABSTRACT

A photoconductive member comprises a support for a photoconductive member, an interface layer comprising an amorphous material containing silicon atoms and nitrogen atoms as constituent atoms, a rectifying layer comprising an amorphous material containing atoms (A) belonging to the group III or the group V of the periodic table as constituent atoms in a matrix of silicon atoms, a first amorphous layer exhibiting photoconductivity and comprising an amorphous material containing at least one member selected from the group consisting of hydrogen atoms and halogen atoms as constituent atoms in a matrix of silicon atoms, and a second amorphous layer containing an amorphous material represented by any of the formulas:

$$Si_aC_{1-a}\ (0.4<a<1)\ldots \quad (1)$$

$$(Si_bC_{1-b})_cH_{1-c}\ (0.5<b<1,\ 0.6\leqq c<1)\ldots \quad (2)$$

$$(Si_dC_{1-d})_eX_{1-e}\ (0.47<d<1,\ 0.8\leqq e<1)\ldots \quad (3)$$

$$(Si_fC_{1-f})_g(H+X)_{1-g}\ (0.47<f<1,\ 0.8\leqq g<1)\ldots \quad (4)$$

wherein X represents a halogen atom.

13 Claims, 3 Drawing Figures

AMORPHOUS PHOTOCONDUCTIVE MEMBER WITH α-SI INTERLAYERS

BACKGROUND OF THE INVENTION

1. Field of the Invention

This invention relates to a photoconductive member having sensitivity to electromagnetic waves such as light (herein used in a broad sense, including ultraviolet rays, visible light, infrared rays, X-rays and gamma-rays).

2. Description of the Prior Arts

Photoconductive materials which constitute photoconductive layers for image forming members for electrophotography in the field of image formation, manuscript reading devices, or solid state image pick-up devices are required to have a high sensitivity, a high SN ratio (Photocurrent ($I_p$)/Dark current ($I_d$)), spectral characteristics matching to those of electromagnetic waves to be irradiated, a rapid response to light, a desired dark resistance value as well as no harm to human bodies during usage. Further, in a solid state image pick-up device, it is also required that the residual image should easily be treated within a predetermined time. In particular, in case of an image forming member for electrophotography to be assembled in an electrophotographic device to be used in an office as office apparatus, the aforesaid harmless characteristic is very important.

From the standpoint as mentioned above, amorphous silicon (hereinafter referred to as "a—Si") has recently attracted attention as a photoconductive material. For example, German Laid-Open Patent Publication Nos. 2746967 and 2855718 disclose applications of a—Si for use in image forming members for electrophotography, and German Laid-Open Patent Publication No. 2933411 an application of a—Si for use in a photoconverting reading device.

However, under the present situation, while the photoconductive members having photoconductive layers constituted of a—Si have been attempted to be improved in various aspects individually including electrical, optical and photoconductive characteristics such as dark resistance value, photosensitivity and response to light, etc., and environmental characteristics during use, and further stability with lapse of time and durability, there remains room for further improvement of overall characteristics.

For instance, when applied to an image forming member for electrophotography, residual potential is frequently observed to remain during use thereof if enhancing photosensitivity and dark resistance are contemplated to be effected at the same time. When such a photoconductive member is repeatedly used for a long time, there will be caused various inconveniences such as accumulation of fatigues by repeated uses or so called ghost phenomenon wherein residual images are formed.

Further, a—Si materials may contain as constituent atoms hydrogen atoms or halogen atoms such as fluorine atoms, chlorine atoms, and the like for improving their electrical, photoconductive characteristics, boron atoms, phosphorus atoms, etc. for controlling the electroconductivity type as well as other atoms for improving other characteristics. Depending on the manner in which these constituent atoms are contained, there may sometimes be caused problems with respect to electrical, photoconductive characteristics or dielectric strength, and further durability of the layer formed.

That is, for example, when used as an image forming member for electrophotography, the life of the photocarriers generated by light irradiation in the photoconductive layer formed is insufficient, or at the dark portion, the charges injected from the support side cannot be sufficiently impeded, or there are formed defective images commonly called as "blank areas" on the images transferred to a receiving paper which may be considered to be due to the local discharge destroying phenomenon, or defective images commonly called as "white lines" which may be considered to be caused by, for example, scraping with a blade employed for cleaning. Also, when used in a highly humid atmosphere or immediately after being allowed to stand in a highly humid atmosphere for a long time, so called "faint image" is frequently observed in images obtained.

Further, when the layer thickness is as thick as ten and some microns or higher, there tends to occur such phenomena as loosening or peeling of layers off from the support surface or formation of cracks in the layers with lapse of time when allowed to stand after taking out from a vacuum deposition chamber for layer formation. These phenomena will occur particularly frequently when the support is a drum-shaped support conventionally employed in the field of electrophotography. Thus, there are problems to be solved with respect to stability with lapse of time.

Thus, it is required in designing a photoconductive material to make efforts to solve all of the problems as mentioned above along with the improvement of a—Si materials per se.

In view of the above points, the present invention contemplates the achievement obtained as a result of extensive studies made comprehensively from the standpoints of applicability and utility of a—Si as a photoconductive member for image forming members for electrophotography, solid stage image pick-up devices, reading devices, etc. It has now been found that a photoconductive member having a photoconductive layer comprising an amorphous material which is constituted of so called hydrogenated amorphous silicon, halogenated amorphous silicon or halogen-containing hydrogenated amorphous silicon which is an amorphous material containing at least one of hydrogen atom (H) and halogen atom (X) in a matrix of silicon atoms (hereinafter referred to comprehensively as a—Si(H,X)), said photoconductive member being prepared by designing so as to have a specific structure, exhibits not only practically extremely excellent characteristics but also surpasses the photoconductive members of the prior art in substantially all respects, and has especially markedly excellent characteristics as a photoconductive member for electrophotography. The present invention is based on such finding.

SUMMARY OF THE INVENTION

A primary object of the present invention is to provide a photoconductive member having electrical, optical and photoconductive characteristics which are substantially constantly stable with virtually no dependence on the environments under use, and said member being markedly excellent in light fatigue resistance and also excellent in humidity resistance and durability without causing deterioration phenomenon when used repeatedly, exhibiting no or substantially no residual potential observed.

Another object of the present invention is to provide a photoconductive member which is excellent in adhesion between a support and a layer provided on the support or between respective laminated layers, stable with a dense structural arrangement and high in layer quality.

Still another object of the present invention is to provide a photoconductive member having sufficiently an ability to retain charges during charging treatment for formation of electrostatic images, when applied as a member for formation of an electrophotographic image and having ordinary electrophotographic characteristics.

Still another object of the present invention is to provide a photoconductive member for electrophotography capable of providing easily a high quality image which is high in density, clear in halftone and high in resolution.

According to the present invention, there is provided a photoconductive member, comprising a support for a photoconductive member, an interface layer comprising an amorphous material containing silicon atoms and nitrogen atoms as constituent atoms, a rectifying layer comprising an amorphous material containing atoms (A) belonging to the group III or the group V of the periodic table as constituent atoms in a matrix of silicon atoms, a first amorphous layer exhibiting photoconductivity and comprising an amorphous material containing at least one member selected from the group consisting of hydrogen atoms and halogen atoms as constituent atoms in a matrix of silicon atoms, and a second amorphous layer containing an amorphous material represented by any of the formulas:

$$Si_aC_{1-a}(0.4<a<1)\ldots \quad (1)$$

$$(Si_bC_{1-b})_cH_{1-c}(0.5<b<1,\ 0.6\leqq c<1)\ldots \quad (2)$$

$$(Si_dC_{1-d})_eX_{1-e}(0.47<d<1,\ 0.8\leqq e<1)\ldots \quad (3)$$

$$(Si_fC_{1-f})_g(H+X)_{1-g}(0.47<f<1,\ 0.8\leqq g<1)\ldots \quad (4)$$

wherein X represents a halogen atom.

DESCRIPTION OF THE PREFERRED EMBODIMENTS

Figure 1:
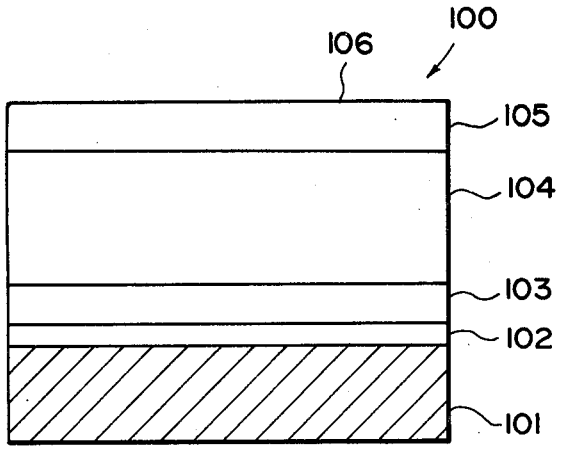
FIG. 1 and FIG. 2 show schematic sectional views for illustration of the layer constitutions of preferred embodiments of the photoconductive member according to the present invention, respectively.

Referring now to the drawings, the photoconductive member of the present invention is to be described in detail.

FIG. 1 shows a schematic sectional view for illustration of a typical exemplary constitution of the photoconductive member of this invention.

The photoconductive member 100 as shown in FIG. 1 is provided with an interface layer 102, a rectifying layer 103 and a first amorphous layer (I) 104 having photoconductivity and a second amorphous layer (II) 105 comprising an amorphous material represented by any of the above formula (1) to (4) (hereinafter abbreviated as "a—SiC(H,X)") on a support 101 for photoconductive member, said amorphous layer (II) 105 having a free surface 106.

The interface layer 102 is provided primarily for the purpose of enhancement of adhesion between the support 101 and the rectifying layer 103, and has an affinity to both the support 101 and the rectifying layer 103.

The rectifying layer 103 has a function primarily of preventing effectively injection of charges from the side of the support 101 into the amorphous layer 104.

The amorphous layer (I) 104 has a function to receive irradiation of a light to which it is sensitive thereby to generate photocarriers in said layer (I) 104 and transport said photocarriers in a predetermined direction.

The amorphous layers (II) 105 is provided primarily for the purpose of accomplishing the objects of the present invention with respect to humidity resistance, continuous repeated use characteristics, dielectric strength, environmental characteristics in use and durability.

The interface layer in the present invention is constituted of an amorphous material containing silicon atoms as a matrix and nitrogen atoms, if desired, together with at least one member of hydrogen atoms (H) and halogen atoms (X), as constituent atoms (hereinafter referred to as a—SiN(H,X)).

As the a—SiN(H,X), there may be included an amorphous material containing nitrogen atoms (N) as constituent atoms in a matrix of silicon atoms (Si) (hereinafter referred to as "a—$Si_aN_{1-a}$"), an amorphous material containing nitrogen atoms (N) and hydrogen atoms (H) as constituent atoms in a matrix of silicon atoms (Si) (hereinafter referred to as "a—$(Si_bN_{1-b})_cH_{1-c}$") and an amorphous material containing nitrogen atoms (N) and halogen atoms (X), if desired, together with hydrogen atoms (H), as constituent atoms in a matrix of silicon atoms (Si) (hereinafter referred to as "a—$(Si_dN_{1-d})_e(H,X)_{1-e}$").

In the present invention, illustrative as the halogen atom (X) to be optionally incorporated in the interface layer are fluorine, chlorine, bromine and iodine, preferred with fluorine and chlorine.

As the method for layer formation in the case of constituting an interface layer with the above amorphous layer, there may be employed the glow discharge method, the sputtering method, the ion implantation method, the ion plating method, the electron beam method, etc. These preparation methods may be suitably selected depending on various factors such as the preparation conditions, the extent of the load for capital investment for installations, the production scale, the desirable characteristics required for the photoconductive member to be prepared, etc. For the advantages of relatively easy control of the preparation conditions for preparing photoconductive members having desired characteristics and easy introduction of silicon atoms and nitrogen atoms, optionally together with hydrogen atoms or halogen atoms, into the interface layer to be prepared, there may be preferably employed the glow discharge method or the sputtering method.

Further, in the present invention, the interface layer may be formed by using the glow discharge method and the sputtering method in combination in the same device system. For formation of an interface layer constituted of a—SiN(H,X) according to the glow discharge method, the basic procedure comprises introducing a starting gas capable of supplying silicon atoms (Si) and a starting gas for introduction of nitrogen atoms (N), optionally together with starting gases for introduction of hydrogen atoms (H) and/or for introduction of halogen atoms (X), into a deposition chamber which can be internally brought to a reduced pressure, and exciting glow discharge in said deposition chamber, thereby forming an interface layer comprising a—SiN(H,X) on the surface of a given support located at a predetermined position.

Formation of the interface layer according to the sputtering method may be carried out according to, for example, the following procedures.

According to the first procedure, in carrying out sputtering using a target constituted of Si in an atmosphere of an inert gas such as Ar, He and the like or a gas mixture based on these gases, a starting gas for introduction of nitrogen atoms (N) optionally together with a gas for introduction of hydrogen atoms (H) and/or halogen atoms (X) may be introduced into a vaccum deposition chamber in which sputtering is to be effected.

According to the second procedure, nitrogen atoms (N) can be introduced into the interface layer to be formed by use of a target constituted of $Si_3N_4$ or two sheets of targets constituted of an Si target and an $Si_3N_4$ target, or a target constituted of both Si and $Si_3N_4$. During this operation, the aforesaid starting gas for introduction of nitrogen atoms (N) can be used in combination, whereby the content of the nitrogen atoms (N) to be incorporated into the interface layer can be freely controlled as desired by controlling the flow rate of said gas.

The content of the nitrogen atoms (N) to be incorporated into the interface layer may be controlled freely as desired by controlling the flow rate of the starting gas for introduction of nitrogen atoms (N) when it is introduced into a deposition chamber, or adjusting the proportion of the nitrogen atoms (N) contained in a target for introduction of nitrogen atoms (N) during preparation of said target, or conducting both of these methods.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and the like as effective materials. In particular, $SiH_4$ and $Si_2H_6$ are preferred with respect to easy handling during layer formation and efficiency for supplying Si.

By use of these starting materials, H together with Si can be introduced into the interface layer to be formed by appropriate selection of layer forming conditions.

As the effective starting material for supplying Si other than the above hydrogenated silicons, there may be mentioned silicon compounds containing halogen atoms (X), namely so called silane derivatives substituted with halogens. More specifically, preferable silicon halides may include $SiF_4$, $Si_2F_6$, $SiCl_4$, $SiBr_4$ and the like. Further, there may be also included gaseous or gasifiable silicon halides containing hydrogen atoms as one of the constituent, such as $SiH_2F_2$, $SiH_2I_2$, $SiH_2Cl_2$, $SiHCl_3$, $SiH_2Br_2$, $SiHBr_3$ and the like, as the effective starting material for supplying Si for formation of the interface layer.

Also, in case when these silicon compounds containing halogen atoms (X) are to be used, the aforementioned silicon halide compounds containing hydrogen atoms, among the starting materials capable of introducing X together with Si into the interface layer to be formed by appropriate selection of layer forming conditions as described above, may be used as preferable starting materials for introduction of halogen atoms (X) in the present invention, because hydrogen atoms (H) which are very effective for controlling electric or photoelectric characteristics can be introduced simultaneously with introduction of halogen atoms (X).

Typical examples of the starting materials for forming the interface layer and useful as the starting gas for introduction of halogen atoms may include, in addition to those mentioned above, halogen gases such as fluorine, chlorine, bromine and iodine, interhalogen compounds such as BrF, ClF, $ClF_3$, $BrF_5$, $BrF_3$, $IF_3$, $IF_7$, ICl, IBr, and the like and hydrogen halides such as HF, HCl, HBr, HI and the like.

As the starting materials which can be effectively used as starting gases for introduction of nitrogen atoms in formation of an interface layer, there may be mentioned gaseous or gasifiable nitrogen compounds constituted of N or N and H such as nitrogen, nitrides and azides, including, for example, nitrogen ($N_2$), ammonia ($NH_3$), hydrazine ($H_2NNH_2$), hydrogen azide ($HN_3$), ammonium azide ($NH_4N_3$) and so on. Alternatively, for the advantage of introducing halogen atoms (X) in addition to nitrogen atoms (N), there may be also employed nitrogen halide compounds such as nitrogen trifluoride ($F_3N$), nitrogen tetrafluoride ($F_4N_2$) and the like.

In the present invention, as the diluting gas to be used in formation of an interface layer according to the glow discharge method or the sputtering method, there may be included, for example, so called rare gases such as He, Ne, Ar and the like as preferable ones.

Since the function of the interface layer is to consolidate adhesion between the support and the rectifying layer and, in addition, to make electrical contact therebetween uniform the amorphous material a—SiN(H,X) constituting the interface layer of the present invention is desired to be carefully prepared by selecting strictly the conditions for preparation of the interface layer so that the interface layer may be endowed with the required characteristics as desired.

As an important factor among the layer forming conditions for formation of an interface layer comprising a—SiN(H,X) having the characteristics adapted for the objects of the present invention, there may be mentioned the support temperature during layer formation. That is, in forming an interface layer comprising a—SiN(H,X) on the surface of a support, the support temperature during layer formation is an important factor having influences on the structure and the characteristics of the layer to be formed. In the present invention, the support temperature during layer formation is desired to be strictly controlled so that a—SiN(H,X) having the intended characteristics may be prepared as desired. The support temperature in forming the interface layer for accomplishing effectively the objects of the present invention, which should be selected within the optimum range in conformity with the method for formation of the interface layer is desired to be generally 50° C. to 250° C., preferably 100° C. to 250° C. In practicing formation of the interface layer, employment of the glow discharge method or the sputtering method is advantageous since it is possible to form continuously from the interface layer to the rectifying layer, the amorphous layer, further other layers optionally formed on the amorphous layer, in the same system and furthermore severe control of the composition ratio of the atoms constituting respective layers or control of the layer thicknesses can be done with relative ease as compared with other methods. When the interface layer is formed according to these layer forming methods, the discharging power and the gas pressure during layer formation may be mentioned as important factors similarly as the aforesaid support temperature which have influences on the characteristics of the interface layer to be prepared.

The discharging power condition for preparing effectively the interface layer having the characteristics for accomplishing the objects in the present invention with good productivity may be preferably 1 to 300 W, more preferably 2 to 150 W. The gas pressure in a deposition chamber may preferably be $3\times10^{-3}$ to 5 Torr, more preferably $8\times10^{-3}$ to 0.5 Torr.

The content of nitrogen atoms, and the contents of hydrogen atoms (H) and halogen atoms (X) optionally contained in the interface layer in the photoconductive member of the present invention, are also important factors, similarly as the conditions for preparation of the interface layer, for forming the interface layer capable of providing the desired characteristics to accomplish the objects of the present invention.

Each of the contents of nitrogen atoms (N), hydrogen atoms (H) and halogen atoms (X) in the interface layer may be determined as desired while considering the layer preparation conditions as described above so that the objects of the present invention may be accomplished effectively.

When the interface layer is to be constituted of a—$Si_aN_{1-a}$, the content of nitrogen atoms (N) in the interface layer may generally be 43 to 60 atomic %, more preferably 43 to 50 atomic %, namely in terms of representation by a, a being preferably 0.4 to 0.57, more preferably 0.5 to 0.57.

When the interface layer is to be constituted of a—$(Si_bN_{1-b})_cH_{1-c}$, the content of nitrogen atoms (N) may preferably be 25 to 55 atomic %, more preferably 35 to 55 atomic %, the content of hydrogen atoms preferably 2 to 35 atomic %, more preferably 5 to 30 atomic %, namely in terms of representation by b and c, b being preferably 0.43 to 0.6, more preferably 0.43 to 0.5 and c being preferably 0.65 to 0.98, more preferably 0.7 to 0.95. When the interface layer is to be constituted of a—$(Si_dN_{1-d})_e$—$(H,X)_{1-e}$, the content of nitrogen atoms may preferably be 30 to 60 atomic %, more preferably 40 to 60 atomic %, the content of halogen atoms or the total content of halogen atoms and hydrogen atoms preferably 1 to 20 atomic %, more preferably 2 to 15 atomic %, and the content of hydrogen atoms in this case preferably 19 atomic % or less, more preferably 13 atomic % or less. In terms of representation by d and e, d may preferably be 0.43 to 0.6, more preferably 0.43 to 0.49, and e preferably 0.8 to 0.99, more preferably 0.85 to 0.98.

The interface layer constituting the photoconductive member in the present invention may have a layer thickness which may suitably be determined depending on the layer thickness of the rectifying layer provided on said interface layer and the characteristics of the rectifying layer.

In the present invention, the interface layer may have a layer thickness preferably of 30 Å to 2μ, more preferably of 40 Å to 1.5μ, most preferably of 50 Å to 1.5μ.

The rectifying layer constituting the photoconductive member of the present invention is constituted of an amorphous material containing the atoms belonging to the group III of the periodic table (the group III atoms) or the atoms belonging to the group V of the periodic table (the group V atoms), preferably together with hydrogen atoms (H) or halogen atoms or both thereof, in a matrix of silicon atoms (Si) (hereinafter referred to as "a—Si(III,V,H,X)"), and its layer thickness t and the content C(A) of the group III atoms or the group V atoms may be suitably determined as desired so that the objects of the present invention may be effectively accomplished.

The layer thickness t of the rectifying layer in the present invention may preferably be 0.3 to 5μ, more preferably 0.5 to 2μ. The aforesaid content C(A) may preferably be $1\times10^2$ to $1\times10^5$ atomic ppm, more preferably $t\times10^2$ to $1\times10^5$ atomic ppm.

In the present invention, the atoms to be used as the atoms belonging to the group III of the periodic table contained in the rectifying layer may include B (boron), Al (aluminum), Ga (gallium), In (indium), Tl (thallium) and the like, particularly preferably B and Ga.

The atoms belonging to the group V of the periodic table contained in the rectifying layer may include P (phosphorus), As (arsenic), Sb (antimony), Bi (bismuth) and the like, particularly preferably P and As.

For formation of a rectifying layer constituted of a—Si(III,V,H,X), there may be adopted the vacuum deposition method utilizing discharging phenomenon, such as the glow discharge method, the sputtering method or the ion-plating method, similarly as in formation of an interface layer.

For example, for formation of a rectifying layer constituted of a—Si(III,V,H,X) according to the glow discharge method, the basic procedure comprises introducing a starting gas capable of supplying the group III atoms or a starting gas capable of supplying the group V atoms, and optionally a starting gas for introduction of hydrogen atoms (H) and/or halogen atoms (X), together with a starting gas for supplying silicon atoms (Si), into a deposition chamber which can be internally brought to a reduced pressure, wherein glow discharge is excited thereby to form a layer comprising a—Si(III,V,H,X) on the surface of a support placed at a predetermined position in the chamber. When it is to be formed according to the sputtering method, a starting gas for introduction of the group III atoms or the starting gas for introduction of the group V atoms, optionally together with gases for introduction of hydrogen atoms and/or halogen atoms, may be introduced into the chamber into a deposition chamber for sputtering when effecting sputtering with a target constituted of Si in an atmosphere of an inert gas such as Ar, He or a gas mixture based on these gases.

As the starting materials which can be used as the starting gases for formation of the rectifying layer, there may be employed those selected as desired from the same starting materials as used for formation of the interface layer, except for the starting materials to be used as the starting gases for introduction of the group III atoms and the group V atoms.

For introducing the group III atoms or the group V atoms structurally into the rectifying layer, the starting material for introduction of the group III atoms or the starting material for introduction of the group V atoms may be introduced under gaseous state into a deposition chamber together with other starting materials for formation of the rectifying layer. As the material which can be used as such starting materials for introduction of the group III atoms or the group V atoms, there may be desirably employed those which are gaseous under the conditions of normal temperature and normal pressure, or at least readily gasifiable under layer forming conditions.

Illustrative of such starting materials for introduction of the group III atoms, in particular, boron, are boron hydrides such as $B_2H_6$, $B_4H_{10}$, $B_5H_9$, $B_5H_{11}$, $B_6H_{10}$, $B_6H_{12}$, $B_6H_{14}$ and the like, boron halides such as $BF_3$, $BCl_3$, $BBr_3$ and the like. In addition, there may also be included $AlCl_3$, $GaCl_3$, $Ga(CH_3)_3$, $InCl_3$, $TlCl_3$ and the like.

Illustrative of the starting materials for introduction of the group V atoms, in particular, phosphorus, are phosphorus hydrides such as $PH_3$, $P_2H_4$ and the like, phosphorus halides such as $PH_4I$, $PF_3$, $PF_5$, $PCl_3$, $PCl_5$, $PBr_3$, $PBr_5$, $PI_3$ and the like. In addition, there may also be included $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_3$ and the like, as effective materials for introduction of the group V atoms.

In the present invention, the group III atoms or the group V atoms to be contained in the rectifying layer for imparting rectifying characteristic may preferably be distributed substantially uniformly within the planes substantially parallel to the layer surface of the rectifying layer (planes parallel to the surface of the support) and in the direction of the layer thickness.

In the present invention, the content of the group III atoms and the group V atoms to be introduced into the rectifying layer can be controlled freely by controlling the gas flow rates of the starting materials for introduction of the group III atoms and the group V atoms, the gas flow rate ratio, the discharging power, the support temperature, the pressure in the deposition chamber and others.

In the present invention, as the halogen atoms (X), which may be introduced into the rectifying layer, if necessary, there may be included those as mentioned above concerning description about the interface layer.

In the present invention, formation of a first amorphous layer (I) constituted of a—Si(H,X) may be conducted by the vacuum deposition method utilizing discharging phenomenon, such as the glow discharge method, the sputtering method or the ion-plating method. For example, for formation of a first amorphous layer (I) constituted of a—Si(H,X) according to the glow discharge method, the basic procedure comprises introducing a starting gas capable of supplying a starting gas for introduction of hydrogen atoms (H) and/or halogen atoms (X) together with a starting gas for supplying silicon atoms (Si), into a deposition chamber which can be internally brought to a reduced pressure, wherein glow discharge is effected thereby to form a layer comprising a—Si(H,X) on the surface of a rectifying layer on a support placed at a predetermined position in the chamber. When it is to be formed according to the sputtering method, a starting gas for introduction of hydrogen atoms and/or halogen atoms may be introduced into the chamber for sputtering when effecting sputtering with a target constituted of Si in an atmosphere of an inert gas such as Ar, He or a gas mixture based on these gases.

In the present invention, as the halogen atoms (X), which may be introduced into a first amorphous layer (I), if necessary, there may be included those as mentioned above concerning description about the interface layer.

The starting gas to be used for formation of a first amorphous layer (I) in the present invention may include gaseous or gasifiable hydrogenated silicons (silanes) such as $SiH_4$, $Si_2H_6$, $Si_3H_8$, $Si_4H_{10}$ and others as mentioned in description about the interface layer or the rectifying layer as effective materials. In particular, $SiH_4$ and $Si_2H_6$ are preferred with respect to easy handling during formation and efficiency for supplying Si.

As the effective starting gas for incorporation of halogen atoms to be used in the present invention for formation of a first amorphous layer (I), there may be employed a number of halogen compounds similarly as in case of an interface layer, including gaseous or gasifiable halogen compounds such as halogen gases, halides, interhalogen compounds, silane derivatives substituted with halogens and the like.

Further, there may also be included gaseous or gasifiable silicon compounds containing halogen atoms, comprising silicon atoms (Si) and halogen atoms (X) as constituents, as effective materials to be use in the present inventions.

In the present invention, the amount of hydrogen atoms (H) or halogen atoms (X) or the sum (H+X) of hydrogen atoms (H) and halogen atoms (X) to be contained in the rectifying layer and the first amorphous layer (I) is desired to be in the range generally from 1 to 40 atomic %, preferably from 5 to 30 atomic %. For controlling the amount of hydrogen atoms (H) and/or halogen atoms (X) to be contained in the rectifying layer or in the first amorphous layer (I), for example, the support temperature, the amount of the starting material to be used for incorporation of hydrogen atoms (H) and/or halogen atoms (X), discharging power and others may be controlled.

In the present invention, as diluting gases to be used in formation of the first amorphous layer (I) according to the glow discharge method or as gases for sputtering during formation according to the sputtering method, there may be preferably employed so called rare gases such as He, Ne, Ar and the like.

In the present invention, the first amorphous layer (I) may have a layer thickness, which may be suitably determined depending on the characteristics required for the photoconductive member prepared, but desirably within the range generally from 1 to 100μ, preferably from 1 to 80μ, more preferably from 2 to 50μ.

In the present invention, when the group V atoms are to be incorporated in the rectifying layer, the conduction characteristic of said layer should desirably be controlled freely by incorporating a substance for controlling the conduction characteristic different from the group V atoms in the first amorphous layer (I).

As such a substance, there may be mentioned the so called impurities in the field of semiconductors, preferably p-type impurities for imparting p-type conduction characteristic to a—Si(H,X) constituting the first amorphous layer (I) to be formed in the present invention, typically the atoms belonging to the aforesaid group III of the periodic table (the group III atoms).

In the present invention, the content of the substance for controlling the conduction characteristic contained in the first amorphous layer (I) may be selected suitably depending on organic relationships with the conduction characteristic required for said first amorphous layer (I), the characteristics of other layer provided in direct contact with said layer, the characteristic at the contacted interface with said other layers, etc.

In the present invention, the content of the substance for controlling the conduction characteristic in the first amorphous layer (I) is desired to be generally 0.001 to 1000 atomic ppm, preferably 0.05 to 500 atomic ppm, most preferably 0.1 to 200 atomic ppm.

In the present invention, the second amorphous layer (II) is constituted of any of a—SiC, a—SiCH, a—SiCX and a—SiC(H+X) as described above.

Formation of the second amorphous layer (II) constituted of any of the above amorphous materials may be performed according to the flow discharge method, the sputtering method, the ion implantation method, the ion plating method, the electron beam method, etc. These preparation methods may be suitably selected depending on various factors such as the preparation conditions, the extent of the load for capital investment for installations, the production scale, the desirable characteristics required for the photoconductive member to be prepared, etc. For the advantages of relatively easy control of the preparation conditions for preparing photoconductive members having desired characteristics and easy introduction of carbon atoms and, optionally hydrogen atoms or halogen atoms, together with silicon atoms (Si) into the second amorphous layer (II) to be prepared, there may preferably be employed the electron beam method, the ion plating method, the glow discharge method or the sputtering method.

For formation of a second amorphous layer (II) constituted of a—SiC by the sputtering method, a single crystalline or polycrystalline Si wafer or C wafer or a wafer containing a mixture of Si and C is used as target and subjected to sputtering in an atmosphere of various gases.

For example, when both of Si wafer and C wafer are used as target, a gas for sputtering such as He, Ne, Ar, etc. is introduced into a deposition chamber for sputter to form a gas plasma therein and effect sputtering by using said Si wafer and C wafer.

Alternatively, by use of one sheet target formed as a mixture of Si and C, a gas for sputtering is introduced into a device system and sputtering is effected in the atmosphere of said gas.

When the electron beam method is employed, a single crystalline or polycrystalline high purity silicon and a high purity graphite may be placed in two evaporation boats, respectively, and vapor deposition may be effected at the same time independently of each other with electron beam, or alternatively vapor deposition may be effected with a single electron beam using silicon and graphite placed in the same evaporation boat. The composition ratio of silicon atoms to carbon atoms in the second amorphous layer (II) may be controlled, in the former case, by varying the acceleration voltage of electron beam relative to silicon and graphite, respectively, while in the latter case, by determining previously the mixed amounts of silicon and graphite.

When the ion plating method is employed, various gases are introduced into a vapor deposition tank and a high frequency electric field is applied on a coil previously wound around the vapor deposition tank to form glow therein, under which state Si and C may be vapor deposited by utilization of the electron beam method.

For formation of the second amorphous layer (II) constituted of a—SiCH according to the glow discharge method, starting gases for formation of a—SiCH, which may optionally be mixed with a diluting gas at a predetermined mixing ratio, may be introduced into a deposition chamber for vacuum deposition in which a support is placed, and glow discharge is excited in said deposition chamber to form the gases introduced into a gas plasma, thereby depositing a—SiCH on the first amorphous layer (I) already formed on the support.

In the present invention, as the starting materials which can effectively used as the starting gases for formation of a—SiCH, there may be employed most of substances containing at least one of Si, C and H as constituent atoms which are gaseous or gasified substances of readily gasifiable ones.

When a starting gas containing Si as a constituent atom as one of Si, C and H, is used, there may be employed, for example, a mixture of a starting gas containing Si as constituent atom, a starting gas containing C as constituent atom and a starting gas containing H as constituent atom at a desired mixing ratio, or a mixture of a starting gas containing Si as constituent atom and a starting gas containing C and H as constituent atoms also at a desired ratio, or a mixture of a starting gas containing Si as constituent atom and a starting gas containing three constituent atoms of Si, C and H.

Alternatively, it is also possible to use a mixture of a starting gas containing Si and H as constituent atoms with a starting gas containing C as constituent atom.

In the present invention, the starting gases effectively used for formation of the second amorphous layer (II) may include hydrogenated silicon gases containing Si and H as constituent atoms such as silanes (e.g. $SiH_4$, $Si_2H_6$, $Si_3H_8$, $Si_4H_{10}$, etc.), compounds containing C and H as constituent atoms such as saturated hydrocarbons having 1 to 5 carbon atoms, ethylenic hydrocarbons having 2 to 5 carbon atoms and acetylenic hydrocarbons having 2 to 4 carbon atoms.

More specifically, there may be included, as saturated hydrocarbons, methane ($CH_4$), ethane ($C_2H_6$), propane ($C_3H_8$), n-butane (n—$C_4H_{10}$), pentane ($C_5H_{12}$); as ethylenic hydrocarbons, ethylene ($C_2H_4$), propylene ($C_3H_6$), butene-1 ($C_4H_8$), butene-2 ($C_4H_8$), isobutylene ($C_4H_8$), pentane ($C_5H_{10}$); as acetylenic hydrocarbons, acetylene ($C_2H_2$), methyl acetylene ($C_3H_4$), butyne ($C_4H_6$); and the like.

As the starting gas containing Si, C and H as constituent atoms, there may be mentioned alkyl silanes such as $Si(CH_3)_4$, $Si(C_2H_5)_4$ and the like. In addition to these starting gases, it is also possible as a matter of course to use $H_2$ as effective starting gas for introduction of H.

For formation of the second amorphous layer (II) constituted of a—SiCH by sputtering, a single crystalline or polycrystalline Si wafer or C wafer or a wafer containing Si and C mixed therein is used as target and subjected to sputtering in an atmosphere of various gases.

For example, when Si wafer is used as target, a starting gas for introducing C and H, which may be diluted with a diluting gas, if desired, is introduced into a deposition chamber for sputter to form a gas plasma therein and effect sputtering by using said Si wafer.

Alternatively, Si and C as separate targets or one sheet target of a mixture of Si and C can be used and sputtering is effected in a gas atmosphere containing, if necessary, at least hydrogen atoms.

As the starting gas for introduction of C or H, there may be employed those as mentioned in the glow discharge as described above as effective gases also in case of sputtering.

For formation of the second amorphous layer (II) constituted of a—SiCX according to the glow discharge method, starting gases for formation of a—SiCX, which may optionally be mixed with a diluting gas at a predetermined mixing ratio, may be introduced into a deposition chamber for vacuum deposition in which a support is placed, and glow discharge is excited in said deposition chamber to form the gases introduced into a gas plasma, thereby depositing a—SiCX on the first amorphous layer (I) already formed on the support.

In the present invention, as the starting materials which can effectively be used as the starting gases for formation of a—SiCX, there may be employed most of substances containing at least one of Si, C and X as constituent atoms which are gaseous or gasified substances of readily gasifiable ones.

When a starting gas containing Si as a constituent atom as one of Si, C and X, is used, there may be employed, for example, a mixture of a starting gas containing Si as constituent atom, a starting gas containing C as constituent atom and a starting gas containing X as constituent atom at a desired mixing ratio, or a mixture of a starting gas containing Si as constituent atom and a starting gas containing C and X as constituent atoms also at a desired ratio, or a mixture of a starting gas containing Si as constituent atom and a starting gas containing three constituent atoms of Si, C and X.

Alternatively, it is also possible to use a mixture of a starting gas containing Si and X as constituent atoms with a starting gas containing C as constituent atom.

In the present invention, preferable halogen atoms (X) to be contained in the second amorphous layer (II) are F, Cl, Br and I. Particularly, F and Cl are preferred.

In the present invention, when the second amorphous layer (II) is constituted of a—SiCX, it is also possible to further incorporate hydrogen atoms thereinto. In this case, incorporation of hydrogen atoms intc the second amorphous layer (II) is convenient from aspect of production cost, because a part of starting gas species can be made common in forming continuous layers together with the first amorphous layer (I).

In the present invention, as the starting gases effectively employed for constitution of the second amorphous layer (II) of a—SiCX or a—SiC(H+X), there may be included, in addition to the starting gases mentioned in case of a—SiCH, single halogen substances, hydrogen halides, interhalogen atoms, silicon halides, halo-substituted hydrogenated silicons and the like.

More specifically, there may be mentioned, as single halogen substances, halogenic gases such as of fluorine, chlorine, bromine and iodine; as hydrogen halides, HF, HI, HCl, HBr; as interhalogen compounds, BrF, ClF, $ClF_3$, $ClF_5$, $BrF_5$, $BrF_3$, $IF_7$, $IF_5$, ICl, IBr; as silicon halides, $SiF_4$, $Si_2F_6$, $SiCl_4$, $SiCl_3Br$, $SiCl_2Br_2$, $SiClBr_3$, $SiCl_3I$, $SiBr_4$, as halo-substituted hydrogenated silicon, $SiH_2F_2$, $SiH_2Cl_2$, $SiHCl_3$, $SiH_3Cl$, $SiH_3Br$, $SiH_2Br_2$, $SiHBr_3$.

In addition to these materials, there may also be employed halo-substituted paraffinic hydrocarbons such as $CCl_4$, $CHF_3$, $CH_2F_2$, $CH_3F$, $CH_3Cl$, $CH_3Br$, $CH_3I$, $C_2H_5Cl$ and the like, fluorinated sulfur compounds such as $SF_4$, $SF_6$ and the like, halo-containing alkyl silanes such as $SiCl(CH_3)_3$, $SiCl_2(CH_3)_2$, $SiCl_3CH_3$ and the like, as effective materials.

For formation of the second amorphous layer (II) constituted of a—SiCX or a—SiC(H+X) according to the sputtering method, a single crystalline or polycrystalline Si wafer or C wafer or a wafer containing Si and C mixed therein is used as target and subjected to sputtering in an atmosphere of various gases containing halogen atoms and, optionally hydrogen atoms, as constitute atoms.

For example, when Si wafer is used as target, a starting gas for introducing C and X, which may be diluted with a diluting gas, if desired, is introduced into a deposition chamber for sputter to form a gas plasma therein and effect sputtering with said Si wafer.

Alternatively, Si and C as separate targets or one sheet target of a mixture of Si and C and be used and sputtering is effected in a gas atmosphere containing at least halogen atoms. As the starting gas for introduction of C and X, and optionally H, there may be employed those used for forming the second amorphous layer (II) as mentioned in the glow discharge as described above as effective gases also in case of sputtering.

In the present invention, the starting materials for formation of the above second amorphous layer (II) may be selected and employed as desired in formation of the second amorphous layer (II) so that silicon atoms, carbon atoms and optionally hydrogen atoms and/or halogen atoms may be contained at a predetermined composition ratio in the second amorphous layer (II) to be formed.

For example, $Si(CH_3)_4$ as the material capable of incorporating easily silicon atoms, carbon atoms and hydrogen atoms and forming a second amorphous layer (II) having desired characteristics and $SiHCl_3$, $SiCl_4$, $SiH_2Cl_2$ or $SiH_3Cl$ as the material for incorporating halogen atoms may be mixed at a predetermined mixing ratio and introduced under gaseous state into a device for formation of a second amorphous layer (II), followed by excitation of glow discharge, whereby there can be formed a second amorphous layer (II) comprising a—$Si_xC_{1-x}$:Cl:H.

In the present invention, as the diluting gas to be used in forming the second amorphous layer (II) by the glow discharge method or the sputtering method, there may preferably be employed so called rare gases such as He, Ne, Ar and the like.

The second amorphous layer (II) in the present invention should be carefully formed so that the required characteristics may be given exactly as desired.

That is, the above-mentioned amorphous material constituting the second amorphous layer (II) can take various forms electrical properties from conductive through semi-conductive to insulating and photoconductive properties from photoconductive to non-photoconductive depending on the preparation conditions. Therefore, in the present invention, the preparation conditions are strictly selected as desired so that there may be formed the above mentioned amorphous material having desired characteristics depending on the purpose.

For example, when the second amorphous layer (II) is to be provided primarily for the purpose of improvement of dielectric strength, the above mentioned amorphous material is prepared as an amorphous material having marked electric insulating behaviours under the usage conditions.

Alternatively, when the primary purpose for provision of the second amorphous layer (II) is improvement of continuous repeated use characteristics or environmental use characteristics, the degree of the above electric insulating property may be alleviated to some extent and the amorphous material may have sensitivity to some extent to the light irradiated.

In forming the second amorphous layer (II) comprising the above mentioned amorphous material on the surface of the first amorphous layer (I), the support temperature during layer formation is an important factor having influences on the structure and the characteristics of the layer to be formed, and it is desired in the present invention to control severely the support temperature during layer formation so that the second amorphous layer (II) having intended characteristics may be prepared as desired.

As the support temperature in forming the second amorphous layer (II) for accomplishing effectively the objects in the present invention, there may be selected suitably the optimum temperature range in conformity with the method for forming the second amorphous layer (II). When the second amorphous layer (II) is to be formed of a—SiC, the support temperature may preferably be 20° to 300° C., more preferably 20° to 250° C.

When the second amorphous layer (II) is to be formed of other amorphous materials, the support temperature may preferably be 100° to 300° C., more preferably 150° to 250° C.

For formation of the second amorphous layer (II), the sputtering discharge method or the electron beam may be advantageously adopted, because severe control of the composition ratio of atoms constituting the layer or control of layer thickness can be conducted with relative ease as compared with other methods. In case that the second amorphous layer (II) is to be formed according to these layer forming methods, the discharging power during layer formation is one of important factors influencing the characteristics of the above amorphous material to be prepared, similarly as the aforesaid support temperature.

The discharging power condition for preparing effectively the above amorphous material having characteristics for accomplishing the objects of the present invention with good productivity may preferably be 50 W to 250 W, most preferably 80 W to 150 W in case of a—SiC. In case of other amorphous materials for formation of the second amorphous layer (II), the discharging power conditions may preferably be 10 to 300 W, more preferably 20 to 200 W.

The gas pressure in a deposition chamber may generally be 0.01 to 1 Torr, preferably 0.1 to 0.5 Torr when the second amorphous layer (II) is produced in the present invention.

In the present invention, the above numerical ranges may be mentioned as preferable numerical ranges for the support temperature, discharging power for preparation of the second amorphous layer (II). However, these factors for layer formation should not be determined separately independently of each other, but it is desirable that the optimum values of the layer forming factors are determined based on mutual organic relationships so that a second amorphous layer (II) comprising the above amorphous material having desired characteristics may be formed.

The respective contents of carbon atoms, hydrogen atoms and halogen atoms in the amorphous material constituting the second amorphous layer (II) in the photoconductive member of the present invention are important factors for obtaining the desired characteristics to accomplish the objects of the present invention, similarly as the conditions for preparation of the second amorphous layer (II).

The contents of respective atoms in the above amorphous layer constituting the second amorphous layer in the present invention may be generally within the ranges as specified above, but better results may be obtained when they are within the following ranges.

That is, in case of $Si_aC_{1-a}$, a may be preferably 0.4 to 0.99999, more preferably 0.5 to 0.99, most preferably 0.5 to 0.9. In case of $[Si_bC_{1-b}]_cH_{1-c}$, b may be preferably 0.5 to 0.99999, more preferably 0.5 to 0.99, most preferably 0.5 to 0.9, and c preferably 0.6 to 0.99, more preferably 0.65 to 0.98, most preferably 0.7 to 0.95. In case of $[Si_dC_{1-d}]_eX_{1-e}$ and $[Si_fC_{1-f}]_g(H+X)_{1-g}$, d and f may be preferably 0.53 to 0.99999, more preferably 0.5 to 0.99, most preferably 0.5 to 0.9, while e and g may be preferably 0.8 to 0.99, more preferably 0.82 to 0.99, most preferably 0.85 to 0.98.

In case of $[Si_fC_{1-f}]_g(H+X)_{1-g}$, the content of hydrogen atoms may be 19 atomic % or less, more preferably 13 atomic % or less based on the total amount.

The range of the numerical value of layer thickness of the second amorphous layer (II) is desirably determined depending on the intended purpose so as to effectively accomplish the objects of the present invention.

The layer thickness of the second amorphous layer (II) is also required to be determined as desired suitable with due considerations about the relationships with the layer thickness of the first amorphous layer (I), as well as other organic relationships with the characteristics required for respective layer. In addition, it is also desirable to have considerations from economical point of view such as productivity of capability or mass production.

The second amorphous layer (II) in the present invention is desired to have a layer thickness of preferably 0.003 to 30μ, more preferably 0.004 to 20μ, most preferably 0.005 to 10μ.

The support to be used in the present invention may be either electroconductive or insulating. As the electroconductive material, there may be mentioned metals such as NiCr, stainless steel, Al, Cr, Mo, Au, Nb, Ta, V, Ti, Pt, Pd etc. or alloys thereof.

As insulating supports, there may be usually used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. It is desirable that at least one surface of the insulating support is subjected to electroconductive treatment and other layers are provided on the side at which said electroconductive treatment has been applied.

For example, electroconductive treatment to a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$) or the like thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The support may be shaped in any form such as cylinders, belts, plates or others, and its form may be determined as desired. For example, when the photoconductive member 100 in FIG. 1 is to be used as an image forming member for electrophotography, it may desirably be formed into an endless belt or a cylinder for use in continuous high speed copying. The support may have a thickness which is conveniently determined so that a photoconductive member as desired may be formed. When the photoconductive member is required to have a flexibility, the support is made as thin as possible, so far as the function of a support can be exhibited. However, in such a case, the thickness is generally 10μ or more from the points of fabrication and handling of the support as well as its mechanical strength.

Figure 2:
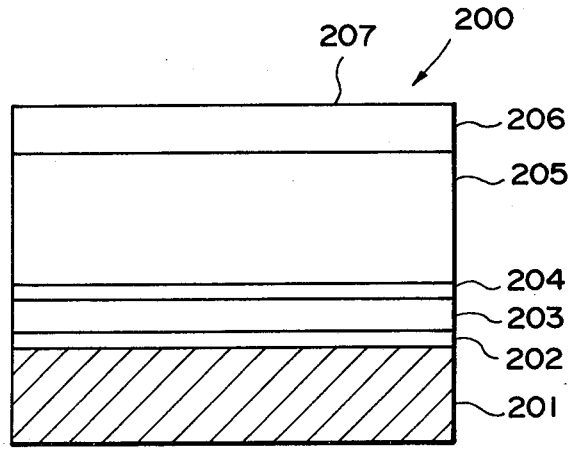

FIG. 2 shows the second preferred embodiment of the photoconductive member of the present invention.

The photoconductive member 200 shown in FIG. 2 is different from the photoconductive member 100 shown in FIG. 1 in point that an upper interface layer 204 is disposed between the rectifying layer 203 and the first amorphous layer (I) 205 exhibiting photoconductivity.

That is, the photoconductive member 200 is provided with a support 201, and, consecutively laminated on said support 201, a lower interface layer 202, a rectifying layer 203, an upper interface layer 204 and a first amorphous layer (I) 205 and a second amorphous layer (II) 206, the second amorphous layer 206 having a free surface 207. The upper interface layer 204 has the function of consolidating adhesion between the rectifying layer 203 and the first amorphous layer (I) 205 thereby to make electrical contact at the interface of both layer uniform, while concomitantly making tough the layer quality of the rectifying layer 203 by being provided directly on the rectifying layer 203.

The lower interface layer 202 and the upper interface layer 204 constituting the photoconductive member 200 as shown in FIG. 2 are constituted of the same amorphous material as in case of the interface layer 102 constituting the photoconductive member 100 as shown in FIG. 1 and may be formed according to the same preparation procedure under the same conditions so that the similar characteristics may be imparted thereto. The rectifying layer 203, the first amorphous layer (I) 205 and the second amorphous layer (II) 206 have also the same characteristics and functions as the rectifying layer 103, the first amorphous layer (I) 104 and the second amorphous layer (II) 105, respectively, and may be formed according to the same layer preparation procedure under the same conditions as in case of FIG. 1.

Figure 3:
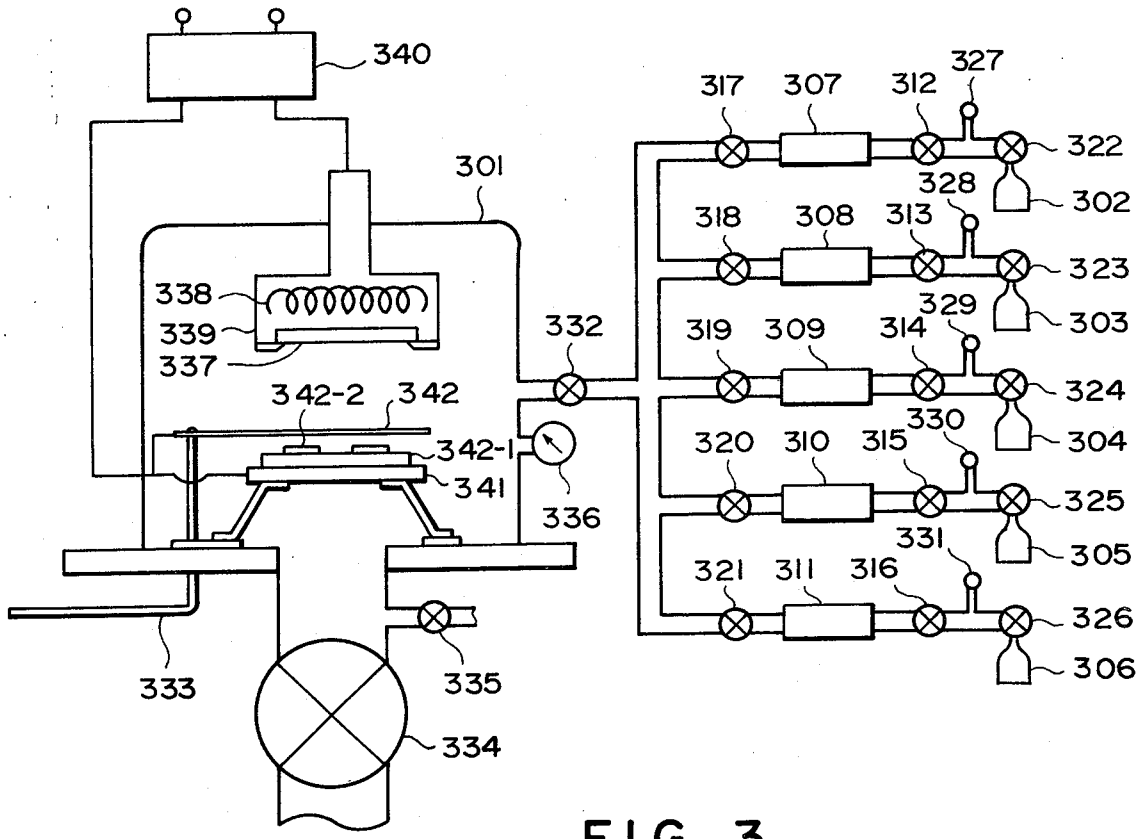
FIG. 3 shows a flow chart for illustration of an example of the device which may be used for preparation of the photoconductive members of the present invention.

Next, the process for producing the photoconductive member formed according to the glow discharge decomposition method is to be described by referring to FIG. 3.

FIG. 3 shows an example of a device for producing a photoconductive member.

In the gas bombs 302 to 306, there are hermetically contained starting gases for formation of respective layers of the present invention. For example, 302 is a bomb containing $SiH_4$ gas diluted with He (purity: 99.999%, hereinafter abbreviated as $SiH_4$/He), 303 is a bomb containing $B_2H_6$ gas diluted with He (purity: 99.999%, hereinafter abbreviated as $B_2H_6$/He), 304 is a bomb containing $N_2$ gas (purity: 99.99%) or $NH_3$ gas (purity: 99.99%), 305 is a bomb containing Ar gas, and 306 is a bomb containing $SiF_4$ gas diluted with He (purity: 99.999%, hereinafter abbreviated as $SiF_4$/He).

For allowing these gases to flow into the reaction chamber 301, on confirmation of the valves 322–326 of the gas bombs 302–306 and the leak valve 335 to be closed, and the inflow valves 312–316, the outflow valves 317–321 and the auxiliary valve 332 to be opened, the main valve 334 is first opened to evacuate the reaction chamber 301 and the gas pipelines.

As the next step, when the reading on the vacuum indicator 336 becomes $5\times10^{-6}$ Torr, the auxiliary valve 332, the inflow valves 312–316 and the outflow valves 317–321 are closed.

Then, the valves of the gas pipelines connected to the bombs of gases to be introduced into the reaction chamber are operated as scheduled to introduce desired gases into the reaction chamber 301.

In the following, one example of the procedure in preparation of a photoconductive member having the constitution as shown in FIG. 1 is to be briefly described.

For forming first an interface layer on a support 337 according to the sputtering method, the shutter 342 is first opened. All the gas supplying valves are once closed, and the reaction chamber 301 is evacuated by opening fully the main valve 334. On the electrode 341 on which high power is to be applied, there are provided a high purity silicon wafer 342-1 and a high purity silicon nitride wafer 342-2 at a desired sputter area ratio as targets.

Ar gas from the bomb 305 and, if necessary, $N_2$ gas from the gas bomb 304 are introduced by operating the respective valves into the reaction chamber 301, and the opening of the main valve 334 is adjusted so that the inner pressure in the reaction chamber 301 may become 0.05 to 1 Torr. The high voltage power source 340 is turned on to effect sputtering of the silicon wafer 342-1 and the silicon nitride wafer 342-2 at the same time, whereby an interface layer constituted of an amorphous layer comprising silicon atoms and nitrogen atoms can be formed on the support 337.

The content of nitrogen atoms in the interface layer can be controlled as desired by controlling the sputter area ratio of silicon wafer to silicon nitride wafer or, when introducing $N_2$ gas or $NH_3$ gas, by controlling the flow rates of $N_2$ gas or $NH_3$ gas. Also, it can be controlled by varying the mixing ratio of silicon powders to $Si_3N_4$ powders during formation of the target.

During the procedure for layer formation, the support 337 is heated at a desired temperature by the heater 338.

Preparation of a rectifying layer on an interface layer may be conducted according to, for example, the procedure as described below.

After formation of an interface has been completed, the power source 340 is turned off for intermission of discharging, and the valves in the whole system for pipelines for introduction of gases in the device are once closed to discharge the gases remaining in the reaction chamber 301 out of the reaction chamber 301, thereby evacuating the chamber to a predetermined degree of vacuum.

Then, with the shutter 342 being closed, the valves 322 and 323 for $SiH_4$/He gas from the gas bomb 302 and $B_2H_6$/He gas from the gas bomb 303, respectively, were opened to adjust the pressures at the outlet pressure gauges 327 and 328 to 1 kg/cm$^2$, respectively, followed by gradual opening of the inflow valves 312 and 313, respectively, to permit the gases to flow into the mass-flow controllers 307 and 308, respectively. Subsequently, by opening gradually the outflow valves 317, 318 and the auxiliary valve 332, the respective gases are permitted to flow into the reaction chamber 301. The outflow valves 317 and 318 are thereby adjusted so that the ratio of the flow rate ratio of $SiH_4$/He gas to $B_2H_6$/He gas may become a desired value, and opening of the main valve 334 is also adjusted while watching the reading on the vacuum indicator 336 so that the pressure in the reaction chamber may become a desired value.

And, after confirming that the temperature of the support 337 is set with the heater 338 within the range of from 50° to 400° C., the power from the power source 340 is set at a desired value to excite glow discharging in the reaction chamber thereby to form a rectifying layer with a desired layer thickness on the interface layer.

Formation of a first amorphous layer (I) exhibiting photoconductivity to be provided on the rectifying layer formed as described above may be performed by use of, for example, $SiH_4$/He gas filled in the bomb 302 according to the same procedure as described in the case of the aforesaid rectifying layer.

As the starting gas species to be used for formation of a first amorphous layer (I), other than $SiH_4$/He gas, there may be employed particularly effectively $Si_2H_6$/He gas for improvement in the layer formation speed.

In case that halogen atoms are to be incorporated in the first amorphous layer (I), $SiF_4$/He gas, for example, may be further added to the above gases before feeding into the reaction chamber 301.

Formation of a second amorphous layer (II) on a first amorphous layer (I) may be preformed according to, for example, the following procedure. First, the shutter 342 is opened. All the gas supplying valves are once closed, and the reaction chamber 301 is evacuated by opening fully the main valve 334.

On the electrode 341 to which high power is to be applied, there are provided a high purity silicon wafer 342-1 and a high purity graphite wafer 342-2 at a desired sputter area ratio as targets. Ar gas from the bomb 305 is introduced into the reaction chamber 301, and the opening of the main valve 334 is adjusted so that the inner pressure in the reaction chamber may become 0.05 to 1 Torr. The high voltage power source 340 is turned on to effect sputtering with targets, whereby a second amorphous layer (II) can be formed on the first amorphous layer (I).

The content of carbon atoms in the second amorphous layer (II) can be controlled as desired by controlling the sputter area ratio of silicon wafer to graphite wafer or the mixing ratio of silicon powders to graphite powders during formation of the target.

The photoconductive member of the present invention designed to have layer constitution as described above can overcome all of the problems as described above and exhibit very excellent electrical, optical, photoconductive characteristics, dielectric strength, and good environmental characteristics in use.

In particular, when it is applied as an image forming member for electrophotography, there is no influence of residual potential on image formation at all, the electrical properties are stable, the sensitivity and the SN ratio is high, the light fatigue resistance is high, the repeated use characteristics is excellent, and it is possible to obtain stably and repeatedly a visible image of high quality with high density, clear halftone and high resolution.

Further, the photoconductive member of the present invention has amorphous layers formed on the support, which are themselves tough and markedly excellent in adhesion to the support, thus enabling repeated and continuous uses at a high speed for a long time.

EXAMPLE 1

By means of the preparation device as shown in FIG. 3, layers were formed on an aluminum substrate under the following conditions.

TABLE 1

| Order of layer formation | Gases employed | Conditions: Flow rate (SCCM) | Flow rate ratio | Discharging power ($W/cm^2$) | Layer thickness |
|---|---|---|---|---|---|
| 1 (Interface layer) | $SiH_4$/He = 1 $NH_3$ | $SiH_4$ = 100 | $SiH_4$:$NH_3$ = 1:30 | 0.18 | 500Å |
| 2 (Rectifying layer) | $SiH_4$/He = 1 $B_2H_6$/He = $10^{-2}$ | $SiH_4$ = 200 | $SiH_4$:$B_2H_6$ = 1:4 × $10^{-3}$ | 0.18 | 4000Å |
| 3 (Amorphous layer (I)) | $SiH_4$/He = 1 | $SiH_4$ = 200 | | 0.18 | 15μ |
| 4 (Amorphous layer (II)) | Ar | 200 | Area ratio Si wafer: graphite = 3:1 | 0.3 | 0.5μ |

A1 substrate temperature : 250° C.
Discharging frequency : 13.56 MHz
Inner pressure in reaction chamber:

| | |
|---|---|
| interface layer | 0.2 Torr |
| rectifying layer, amorphous layer (I) | 0.3 Torr |
| amorphous layer (II) | 0.2 Torr |

The image forming member thus obtained was set in a charging-exposure-developing device, subjected to corona charging at ⊕5 KV for 0.2 sec., followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No peel-off of layer from the substrate occurred and no deterioration of image was observed even after a repetition number of 150,000 or more.

EXAMPLE 2

By means of the preparation device as shown in FIG. 3, layers were formed on an aluminum substrate under the following conditions.

TABLE 2

| Order of layer formation | Gases employed | Conditions: Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 =$ 1:30 | 0.18 | 200Å |
| 2 (Rectifying layer) | $SiH_4/He = 1$ $B_2H_6/He = 10^{-2}$ | $SiH_4 = 200$ | $SiH_4:B_2H_6 =$ $1:2 \times 10^{-3}$ | 0.18 | 4000Å |
| 3 (Amorphous layer (I)) | $SiH_4/He = 1$ | $SiH_4 = 200$ | | 0.18 | 15μ |
| 4 (Amorphous layer (II)) | Ar | 200 | Area ratio Si wafer: graphite = 5:1 | 0.3 | 0.3μ |

Other conditions were the same as in Example 1.

The image forming member thus obtained was set in a charging-exposure-developing device, subjected to corona charging at +5 KV for 0.2 sec., followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 100,000 or more.

EXAMPLE 3

An image forming member was prepared according to entirely the same procedure as in Example 1 except for changing the content ratio of silicon atoms to carbon atoms in the second amorphous layer (II) by changing the area ratio of silicon wafer to graphite during formation of the amorphous layer (II). For the thus obtained image forming member, image evaluation was conducted after repeating for 50,000 times the steps of image making, developing and cleaning to obtain the results as shown in Table 3.

TABLE 3

| | | | | | |
|---|---|---|---|---|---|
| Si:C target (area ratio) | 9:1 | 6.5:3.5 | 4:6 | 1.7:8.3 | 1:9 |
| Si:C (content ratio) | 9.7:0.3 | 8.8:1.2 | 7.3:2.7 | 4.5:5.5 | 3.1:6.9 |
| Image quality evaluation | ○ | ⊙ | ⊙ | ○ | Δ |

⊙: Very good
○: Good
Δ: Practically useful, but ground fogging at white ground portion and peel-off of layer from the substrate slightly formed

EXAMPLE 4

Image forming members were prepared according to entirely the same procedure as in Example 1 except for varying the layer thickness of the amorphous layer (II). By repeating the image making, developing and cleaning steps as described in Example 1, the following results were obtained.

TABLE 4

| Thickness of amorphous layer (II) (μ) | Results |
|---|---|
| 0.001 | Image defect liable to occur |
| 0.02 | No image defect during 20,000 repetitions |
| 0.05 | Stable for 50,000 repetitions or more |
| 1 | Stable for 200,000 repetitions or more |

EXAMPLE 5

An image forming member was prepared according to the same procedure as in Example 1 except for changing the methods for forming the layers other than the amorphous layer (II) to those as shown in Table below, and evaluation was conducted similarly as in Example 1 to obtain good results.

TABLE 5

| Order of layer formation | Gases employed | Conditions: Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 =$ 1:30 | 0.18 | 500Å |
| 2 (Rectifying layer) | $SiH_4/He = 1$ $B_2H/He = 10^{-2}$ | $SiH_4 = 200$ | $SiH_4:B_2H_6 =$ $1:6.0 \times 10^{-3}$ | 0.18 | 6000Å |
| 3 (Interface layer) | $SiH_4/He = 1$ $NH_3$ | 200 | $SiH_4:NH_3 =$ 1:30 | 0.3 | 500Å |
| 4 (Amorphous | $SiH_4/He = 1$ | $SiH_4 = 200$ | | 0.18 | 15μ |

TABLE 5-continued

| Order of layer formation | Gases employed | Conditions: Flow rate (SCCM) | Flow rate ratio | Discharging power ($W/cm^2$) | Layer thickness |
|---|---|---|---|---|---|
| layer (I)) | | | | | |

EXAMPLE 6

By means of the preparation device as shown in FIG. 3, layers were formed on an aluminum substrate under the following conditions.

TABLE 6

| Order of layer formation | Gases employed | Conditions: Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 = 1:30$ | 0.3 | 500Å |
| 2 (Rectifying layer) | $SiH_4/He = 1$ $B_2H_6/He = 10^{-2}$ | $SiH_4 = 200$ | $SiH_4:B_2H_6 = 1:4 \times 10^{-3}$ | 0.18 | 4000Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $C_2H_4$ | $SiH_4 = 100$ | $SiH_4:C_2H_4 = 3:7$ | 0.18 | 0.5μ |

A1 substrate temperature : 250° C.
Discharging frequency : 13.56 MHz
Inner pressure in reaction chamber:

| | |
|---|---|
| interface layer | 0.2 Torr |
| rectifying layer } amorphous layer (I) | 0.3 Torr |
| amorphous layer (II) | 0.2 Torr |

The image forming member for electrophotography thus obtained was set in a copying device, subjected to corona charging at ⊕5 KV for 0.2 sec. and irradiated with a light image. As the light source, a tungsten lamp was employed at 1.0 lux.sec. The latent image was developed with a negatively charged developer (containing toner and carrier) and transferred onto a plain paper. The transferred image was found to be very good. The toner remaining on the image forming member for electrophotography without being transferred was subjected to cleaning by a rubber blade before turning to the next cycle of copying. Such a step was repeated for 150,000 times or more, whereby no peel-off of layer from the substrate occurred and no deterioration of image was observed.

EXAMPLE 7

Layers were formed on an aluminum substrate by means of the preparation device as shown in Fig. 3 under the conditions as shown below.

TABLE 7

| Order of layer formation | Gases employed | Conditions: Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 = 1:30$ | 0.3 | 200Å |
| 2 (Rectifying layer) | $SiH_4/He = 1$ $B_2H_6/He = 10^{-2}$ | $SiH_4 = 200$ | $SiH_4:B_2H_6 = 1:2 \times 10^{-3}$ | 0.18 | 4000Å |
| 3 (Amorphous layer (I)) | $SiH_4/He = 1$ | $SiH_4 = 200$ | | 0.18 | 15μ |
| 4 (Amorphous layer (II)) | $SiH_4/He = 1$ $C_2H_4$ | $SiH_4 = 15$ | $SiH_4:C_2H_4 = 2:1$ | 0.18 | 0.2μ |

EXAMPLE 8

An image forming member was prepared according to entirely the same procedure as in Example 6 except for varying the content ratio of silicon atoms to carbon atoms in the second amorphous layer (II) by varying the flow rate ratio of $SiH_4$ gas and $C_2H_4$gas during formation of the amorphous layer (II). For the thus obtained image forming member, image evaluation was conducted after repeating for 50,000 times the steps up to transfer according to the procedures as described in Example 6 to obtain the results as shown in Table 8.

TABLE 8

| | | | | |
|---|---|---|---|---|
| $SiH_4:C_2H_4$ (Flow rate ratio) | 9:1 | 6:4 | 4:6 | 1:9 |
| Si:C (Content ratio) | 9:1 | 7:3 | 5.5:4.5 | 3:7 |
| Image quality | ○ | ◎ | ○ | Δ |

TABLE 8-continued

| evaluation |
|---|
| ⊚: Very good<br>○: Good<br>Δ: Practically useful, but ground fogging at white ground portion and peel-off of layer from the substrate slightly formed |

EXAMPLE 9

Image forming members were prepared according to entirely the same procedure as in Example 6 except for varying the layer thickness of the amorphous layer (II) as shown in Table 9 below. The results of evaluation are as shown in the following Table 9.

TABLE 9

| Thickness of amorphous layer (II) (μ) | Results |
|---|---|
| 0.001 | Image defect liable to occur |
| 0.02 | No image defect during 20,000 repetitions |
| 0.05 | No image defect during 50,000 repetitions |
| 2 | Stable for 200,000 repetitions or more |

EXAMPLE 10

An image forming member was prepared according to the same procedure as in Example 6 except for changing the methods for forming the layers other than the amorphous layer (II) to those as shown in the Table 10 below, and evaluation was conducted similarly as in Example 6 to obtain good results.

TABLE 10

| Order of layer formation | Gases employed | Conditions: Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 = 1:30$ | 0.18 | 500Å |
| 2 (Rectifying layer) | $SiH_4/He = 1$ $B_2H_6/He = 10^{-2}$ | $SiH_4 = 200$ | $SiH_4:B_2H_6 = 1:6.0 \times 10^{-3}$ | 0.18 | 6000Å |
| 3 (Interface layer) | $SiH_4/He = 1$ $NH_3$ | 200 | $SiH_4:NH_3 = 1:30$ | 0.3 | 500Å |
| 4 (Amorphous layer (I)) | $SiH_4/He = 1$ | $SiH_4 = 200$ | | 0.18 | 15μ |

EXAMPLE 11

By means of the preparation device as shown in FIG. 3, layers were formed on an aluminum substrate under the following conditions.

TABLE 11

| Order of layer formation | Gases employed | Conditions: Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 = 1:30$ | 0.18 | 500Å |
| 2 (Rectifying layer) | $SiH_4/He = 1$ $B_2H_6/He = 10^{-2}$ | $SiH_4 = 200$ | $SiH_4:B_2H_6 = 1:4 \times 10^{-3}$ | 0.18 | 4000Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $SiF_4/He = 0.5$ $C_2H_4$ | $SiH_4 + SiF_4 = 150$ | $SiH_4:SiF_4:C_2H_4 = 1.5:1.5:1$ | 0.18 | 0.5μ |

Al substrate temperature : 250° C.
Discharging frequency : 13.56 MHz
Inner pressure in reaction chamber:

| | |
|---|---|
| interface layer | 0.2 Torr |
| rectifying layer<br>amorphous layer (I) | 0.3 Torr |
| amorphous layer (II) | 0.5 Torr |

The image forming member thus obtained was set in a charging-exposure-developing device, subjected to corona charging at ⊕5 KV for 0.2 sec., followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 150,000 or more.

EXAMPLE 12

By means of the preparation device as shown in FIG. 3, layers were formed on an aluminum substrate under the following conditions.

TABLE 12

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 =$ 1:30 | 0.18 | 200 Å |
| 2 (Rectifying layer) | $SiH_4/He = 1$ $B_2H_6/He = 10^{-2}$ | $SiH_4 = 200$ | $SiH_4:B_2H_6 =$ $1:2 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $SiF_4/He = 0.5$ $C_2H_4$ | $SiH_4 + SiF_4 =$ 15 | $SiH_4:SiF_4:C_2H_4 =$ 0.3:0.1:9.6 | 0.18 | 0.3μ |

Other conditions were the same as in Example 11.

The image forming member thus obtained was set in a charging-exposure-developing device, subjected to corona charging at ⊕5 KV for 0.2 sec., followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 100,000 or more.

EXAMPLE 13

An image forming member was prepared according to entirely the same procedure as in Example 11 except for varying the content ratio of silicon atoms to carbon atoms in the second amorphous layer (II) by varying the flow rate ratio of $SiH_4$ gas : $SiF_4$ gas : $C_2H_4$ gas during formation of the amorphous layer (II). For the thus obtained image forming member, image evaluation was conducted after repeating for 50,000 times the steps of image making, developing and cleaning similarly as described in Example 11 to obtain the results as shown in Table 13.

TABLE 13

| | | | | | |
|---|---|---|---|---|---|
| $SiH_4:SiF_4:C_2H_4$ | 5:4:1 | 3:3.5:3.5 | 2:2:6 | 1:0.7:8.3 | 0.5:0.5:9 |
| Si:C (Content ratio) | 9.5:0.5 | 8.7:1 3 | 7:3 | 4.5:5.5 | 2.9:7.1 |
| Evaluation | ○ | ⊙ | ○ | Δ | Δ |

⊙: Very good
○: Good
Δ: Practically useful, but ground fogging at white ground portion and peel-off of layer from the substrate slightly formed

EXAMPLE 14

Image forming members were prepared according to entirely the same procedure as in Example 11 except for varying the layer thickness of the amorphous layer (II). By repeating the image making, developing and cleaning steps as described in Example 11, the following results were obtained.

TABLE 14

| Thickness of amorphous layer (II) (μ) | Results |
|---|---|
| 0.001 | Image defect liable to occur |
| 0.02 | No image defect during 20,000 repetitions |
| 0.05 | Stable for 50,000 repetitions or more |
| 1 | Stable for 200,000 repetitions or more |

EXAMPLE 15

An image forming member was prepared according to the same procedure as in Example 11 except for changing the methods for forming the layers other than the amorphous layer (II) to those as shown in the Table 15 below, and evaluation was conducted similarly as in Example 11 to obtain good results.

TABLE 15

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 =$ 1:30 | 0.18 | 500 Å |
| 2 (Rectifying layer) | $SiH_4/He = 1$ $B_2H_6/He = 10^{-2}$ | $SiH_4 = 200$ | $SiH_4:B_2H_6 =$ $1:6.0 \times 10^{-3}$ | 0.18 | 6000 Å |
| 3 (Interface layer) | $SiH_4/He = 1$ $NH_3$ | $SiH_4 = 10$ | $SiH_4:NH_3 =$ 1:30 | 0.18 | 500 Å |
| 4 | $SiH_4/He = 1$ | $SiH_4 = 200$ | | 0.18 | 15μ |

TABLE 15-continued

| Order of layer formation | Conditions | | | | |
|---|---|---|---|---|---|
| | Gases employed | Flow rate (SCCM) | Flow rate ratio | Discharging power ($W/cm^2$) | Layer thickness |
| (Amporphous layer (I)) | | | | | |

EXAMPLE 16

An image forming member was prepared according to the same procedure as in Example 11 except for changing the methods for forming the layers other than the amorphous layer (II) to those as shown in the Table 16 below and evaluation was conducted similarly as described in Example 11 to obtain good results.

TABLE 16

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $NH_3$ | $SiH_4 = 100$ | $SiH_4:NH_3 = 1:30$ | 0.18 | 400 Å |
| 2 (Rectifying layer) | $SiH_4/He = 1$ $SiF_4/He = 1$ $B_2H_6/He = 10^{-2}$ | $SiH_4 = 100$ | $SiH_4:SiF_4:B_2H_6 = 1:1:1 \times 10^{-3}$ | 0.18 | 1μ |
| 3 (Amorphous layer (I)) | $SiH_4/He = 1$ $SiF_4/He = 1$ | $SiH_4 = 100$ | $SiH_4:SiF_4 = 1:1$ | 0.18 | 15μ |

EXAMPLE 17

An image forming member was prepared according to the same procedures as in Example 13, except that the amorphous layer (II) was formed by sputtering under the conditions shown below, and evaluated similarly as in Example 13 to obtain good results.

TABLE 17

| | Gases employed | Flow rate (SCCM) | Target area ratio | Discharging power ($W/cm^2$) | Layer thickness (μ) |
|---|---|---|---|---|---|
| Amorphous layer (II) | Ar $SiF_4/He = 0.5$ | $Ar = 200$ $SiF_4 = 100$ | Si wafer:graphite 3:1 | 0.3 | 1 |

EXAMPLE 18

By means of the preparation device as shown in FIG. 3, layers were formed on an aluminum substrate under the following conditions in Table 18.

TABLE 18

| Order of layer formation | Conditions | | | | |
|---|---|---|---|---|---|
| | Gases employed | Flow rate (SCCM) | Flow rate ratio or area ratio | Discharging power ($W/cm^2$) | Layer thickness |
| 1 (Interface layer) | $SiH_4/He = 1$ $NH_3$ | $SiH_4 = 100$ | $SiH_4:NH_3 = 1:30$ | 0.18 | 500 Å |
| 2 (Rectifying layer) | $SiH_4/He = 1$ $PH_3/He = 10^{-2}$ | $SiH_4 = 200$ | $SiH_4:PH_3 = 1:5 \times 10^{-4}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | Ar | 200 | Si wafer:graphite = 3:1 | 0.3 | 0.5μ |

Al substrate temperature : 250° C.

Discharging frequency : 13.56 MHz

Inner pressure in reaction chamber:

| | |
|---|---|
| interface layer | 0.2 Torr |
| rectifying layer } amorphous layer (I) | 0.3 Torr |
| amorphous layer (II) | 0.2 Torr |

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at 1.0 lux.sec using a transmissive type test chart.

Immediately thereafter, a positively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No peel-off of layer from the substrate occurred and no deterioration of image was observed even after a repetition number of 150,000 or more.

EXAMPLE 19

By means of the preparation device as shown in FIG. 3, layers were formed on an aluminum substrate under the following conditions.

TABLE 19

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Interface layer) | $SiH_4/He = 1$ $NH_3$ | $SiH_4 = 100$ | $SiH_4:NH_3 =$ 1:30 | 0.18 | 200 Å |
| 2 (Rectifying layer) | $SiH_4/He = 1$ $PH_3/He = 10^{-2}$ | $SiH_4 = 200$ | $SiH_4:PH_3 =$ $1:1 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | Ar | 200 | Area ratio Si wafer:graphite = 5:1 | 0.3 | 0.3μ |

Other conditions were the same as in Example 18.

The image forming member thus obtained was set in a charging-exposure developing device, subjected to corona charging at ⊖5 KV for 0.2 sec., followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 100,000 or more.

EXAMPLE 20

Image forming members were prepared according to entirely the same procedure as in Example 18 except for varying the content ratio of silicon atoms to carbon atoms in the second amorphous layer (II) by varying the area ratio of silicon wafer to graphite during formation of the amorphous layer (II). For the thus obtained image forming members, image evaluations were conducted after repeating for 50,000 times the steps of image making, developing and cleaning similarly as described in Example 18 to obtain the results as shown in Table 20.

TABLE 20

| | | | | | |
|---|---|---|---|---|---|
| Si:C Target (Area ratio) | 9:1 | 6.5:3.5 | 4:6 | 1.7:8.3 | 1:9 |
| Si:C (Content ratio) | 9.7:0.3 | 8.8:1.2 | 7.3:2.7 | 4.5:5.5 | 3.1:6.9 |
| Image quality evaluation | ○ | ◎ | ◎ | ○ | Δ |

◎: Very good
○: Good
Δ: Practically useful, but ground fogging at white ground portion and peel-off of layer from the substrate slightly fromed

EXAMPLE 21

Image forming members were prepared according to entirely the same procedure as in Example 18 except for varying the layer thickness of the amorphous layer (II). By repeating the image making, developing and cleaning steps as described in Example 18, the following results in Table 21 were obtained.

TABLE 21

| Thickness of amorphous layer (II) (μ) | Results |
|---|---|
| 0.001 | Image defect liable to occur |
| 0.02 | No image defect during 20,000 repetitions |
| 0.05 | Stable for 50,000 repetitions or more |
| 1 | Stable for 200,000 repetitions or more |

EXAMPLE 22

An image forming member was prepared according to the same procedure as in Example 18 except for changing the methods for forming the layers other than the amorphous layer (II) to those as shown in the Table 22 below, and evaluation was conducted similarly as in Example 18 to obtain good results.

TABLE 22

| Order of layer formation | Conditions | | | | |
|---|---|---|---|---|---|
| | Gases employed | Flow rate (SCCM) | Flow rate ratio | Discharging power ($W/cm^2$) | Layer thickness |
| 1 (Lower interface layer) | $SiH_4/He = 1$ $NH_3$ | $SiH_4 = 100$ | $SiH_4:NH_3 =$ 1:30 | 0.18 | 500 Å |
| 2 | $SiH_4/He = 1$ | $SiH_4 = 200$ | $SiH_4:PH_3 =$ | 0.18 | 6000 Å |

TABLE 22-continued

| Order of layer formation | Conditions: Gases employed | Flow rate (SCCM) | Flow rate ratio | Discharging power (W/cm²) | Layer thickness |
|---|---|---|---|---|---|
| (Rectifying layer) | $PH_3/He = 10^{-2}$ | | $1:3.0 \times 10^{-3}$ | | |
| 3 (Upper interface layer) | $SiH_4/He = 1$ $NH_3$ | 200 | $SiH_4:NH_3 = 1:30$ | 0.3 | 500 Å |
| 4 (Amorphous layer (I)) | $SiH_4/He = 1$ | $SiH_4 = 200$ | | 0.18 | 15μ |

EXAMPLE 23

Image forming members were prepared according to the same procedures under the same conditions as in Examples 18, 19 and 22, except that the amorphous layers (I) in respective Examples were formed under the conditions shown in the Table 23 below, and evaluated similarly as in respective Examples to obtain good results.

TABLE 23

| Formed layer | Gases employed | Flow rate (SCCM) | Flow rate ratio | Discharging power (W/cm²) | Layer thickness (μ) |
|---|---|---|---|---|---|
| Amorphous layer (I) | $SiH_4/He = 1$ $B_2H_6/He = 10^{-2}$ | $SiH_4 = 200$ | $SiH_4:B_2H_6 = 1:2 \times 10^{-5}$ | 0.18 | 15 |

EXAMPLE 24

By means of the preparation device as shown in FIG. 3, layers were formed on an aluminum substrate under the following conditions shown in Table 24.

TABLE 24

| Order of layer formation | Conditions: Gases employed | Flow rate (SCCM) | Flow rate ratio | Discharging power (W/cm²) | Layer thickness |
|---|---|---|---|---|---|
| 1 (Interface layer) | $SiH_4/He = 1$ $NH_3$ | $SiH_4 = 100$ | $SiH_4:NH_3 = 1:30$ | 0.18 | 500 Å |
| 2 (Rectifying layer) | $SiH_4/He = 1$ $PH_3/He = 10^{-2}$ | $SiH_4 = 200$ | $SiH_4:PH_3 = 1:5 \times 10^{-4}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $C_2H_4$ | $SiH_4 = 100$ | $SiH_4:C_2H_4 = 3:7$ | 0.18 | 0.5μ |

Al substrate temperature: 250° C.
Discharging frequency: 13.56 MHz
Inner pressure in reaction chamber:

| | |
|---|---|
| interface layer | 0.2 Torr |
| rectifying layer, amorphous layer (I) | 0.3 Torr |
| amorphous layer (II) | 0.2 Torr |

The image forming member for electrophotography thus obtained was set in a copying device, subjected to corona charging at ⊖5 KV for 0.2 sec. and irradiated with a light image. As the light source, a tungsten lamp was employed at 1.0 lux.sec. The latent image was developed with a positively charged developer (containing toner and carrier) and transferred onto a plain paper. The transferred image was found to be very good. The toner remaining on the image forming member for electrophotography without being transferred was subjected to cleaning by a rubber blade before turning to the next cycle of copying. Such a step was repeated for 150,000 times or more, whereby no peel-off of layer from the substrate occurred and no deterioration of image was observed.

EXAMPLE 25

Layers were formed on an aluminum substrate by means of the preparation device as shown in FIG. 3 under the conditions as shown in Table 25 below. For the thus obtained image forming member, evaluation was conducted similarly as in Example 24 to obtain approximately the same results.

TABLE 25

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 =$ 1:30 | 0.3 | 200 Å |
| 2 (Rectifying layer) | $SiH_4/He = 1$ $PH_3/He = 10^{-2}$ | $SiH_4 = 200$ | $SiH_4:PH_3 =$ $1:1 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | $SiH_4/He = 1$ $C_2H_4$ | $SiH_4 = 15$ | $SiH_4:C_2H_4 =$ 2:1 | 0.18 | 0.2μ |

EXAMPLE 26

An image forming member was prepared according to entirely the same procedure as in Example 24 except for varying the content ratio of silicon atoms to carbon atoms in the second amorphous layer (II) by varying the flow rate ratio of $SiH_4$ gas to $C_2H_4$ gas during formation of the amorphous layer (II). For the thus obtained image forming member, image evaluation was conducted after repeating for 50,000 times the steps up to transfer according to the same procedures as described in Example 24 to obtain the results as shown in Table 26.

TABLE 26

| | | | | |
|---|---|---|---|---|
| $SiH_4:C_2H_4$ (Flow rate ratio) | 9:1 | 6:4 | 4:6 | 1:9 |
| Si:C (Content ratio | 9:1 | 7:3 | 5.5:4.5 | 3:7 |
| Image quality evaluation | ○ | ⊙ | ○ | Δ |

⊙: Very good
○: Good
Δ: Practically useful, but ground fogging at white ground portion and peel-off of layer from the substrate slightly formed

EXAMPLE 27

Image forming members were prepared according to entirely the same procedure as in Example 24 except for varying the layer thickness of the amorphous layer (II) as shown in Table 27. The results of evaluation are as shown in the following Table 27.

TABLE 27

| Thickness of amorphous layer (II) (μ) | Results |
|---|---|
| 0.001 | Image defect liable to occur |
| 0.02 | No image defect during 20,000 repetitions |
| 0.05 | Stable for 50,000 repetitions or more |
| 1 | Stable for 200,000 repetitions or more |

EXAMPLE 28

An image forming member was prepared according to the same procedure as in Example 24 except for changing the methods for forming the layers other than the amorphous layer (II) to those as shown in the Table 28 below, and evaluation was conducted similarly as in Example 24 to obtain good results.

TABLE 28

| Order of layer formation | Conditions: Gases employed | Flow rate (SCCM) | Flow rate ratio | Discharging power ($W/cm^2$) | Layer thickness |
|---|---|---|---|---|---|
| 1 (Lower interface layer) | $SiH_4/He = 1$ $NH_3$ | $SiH_4 = 100$ | $SiH_4:NH_3 =$ 1:30 | 0.18 | 500 Å |
| 2 (Rectifying layer) | $SiH_4/He = 1$ $PH_3/He = 10^{-2}$ | $SiH_4 = 200$ | $SiH_4:PH_3 =$ $1:3.0 \times 10^{-3}$ | 0.18 | 6000 Å |
| 3 (Upper interface layer) | $SiH_4/He = 1$ $NH_3$ | 200 | $SiH_4:NH_3 =$ 1:30 | 0.3 | 500 Å |
| 4 (Amorphous layer (I)) | $SiH_4/He = 1$ | $SiH_4 = 200$ | | 0.18 | 15μ |

EXAMPLE 29

Image forming members were prepared according to the same procedures under the same conditions as in Examples 24, 25 and 28 except that the amorphous layers (I) in respective Examples were formed under the conditions shown in the Table 29 below, and evaluated similarly as in respective Examples to obtain good results.

TABLE 29

| Formed layer | Gases employed | Flow rate (SCCM) | Flow rate ratio | Discharging power (W/cm$^2$) | Layer thickness (μ) |
|---|---|---|---|---|---|
| Amorphous layer (I) | $SiH_4/He = 1$ $B_2H_6/He = 10^{-2}$ | $SiH_4 = 200$ | $SiH_4:B_2H_6 = 1:2 \times 10^{-5}$ | 0.18 | 15 |

EXAMPLE 30

By means of the device as shown in FIG. 3, layers were formed on an aluminum substrate under the conditions shown in Table 30 below.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 150,000 or more.

TABLE 30

| Order of layer formation | Conditions: Gases employed | Flow rate (SCCM) | Flow rate ratio | Discharging power (W/cm$^2$) | Layer thickness |
|---|---|---|---|---|---|
| 1 (Interface layer) | $SiH_4/He = 1$ $NH_3$ | $SiH_4 = 100$ | $SiH_4:NH_3 = 1:30$ | 0.18 | 500 Å |
| 2 (Rectifying layer) | $SiH_4/He = 1$ $PH_3/He = 10^{-2}$ | $SiH_4 = 200$ | $SiH_4:PH_3 = 1:5 \times 10^{-4}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $SiF_4/He = 0.5$ $C_2H_4$ | $SiH_4 + SiF_4 = 150$ | $SiH_4:SiF_4:C_2H_4$ 1.5:1.5:1 | 0.18 | 0.5μ |

Al substrate temperature: 250° C.
Discharging frequency: 13.56 MHz
Inner pressure in reaction chamber:

| | |
|---|---|
| interface layer | 0.2 Torr |
| rectifying layer | 0.3 Torr |
| amorphous layer (I) | 0.3 Torr |
| amorphous layer (II) | 0.5 Torr |

EXAMPLE 31

By means of the preparation device as shown in FIG. 3, layers were formed on an aluminum substrate under the following conditions shown in Table 31.

TABLE 31

| Order of layer formation | Conditions: Gases employed | Flow rate (SCCM) | Flow rate ratio | Discharging power (W/cm$^2$) | Layer thickness |
|---|---|---|---|---|---|
| 1 (Interface layer) | $SiH_4/He = 1$ $NH_3$ | $SiH_4 = 100$ | $SiH_4:NH_3 = 1:30$ | 0.18 | 200 Å |
| 2 (Rectifying layer) | $SiH_4/He = 1$ $PH_3/He = 10^{-2}$ | $SiH_4 = 200$ | $SiH_4:PH_3 = 1:1 \times 10^{-1}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $SiF_4/He = 0.5$ $C_2H_4$ | $SiH_4 + SiF_4 = 15$ | $SiH_4:SiF_4:C_2H_4 = 0.3:0.1:9.6$ | 0.18 | 0.3μ |

Other conditions were the same as in Example 30.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 100,000 or more.

EXAMPLE 32

Image forming members were prepared according to entirely the same procedure as in Example 30 except for varying the content ratio of silicon atoms to carbon atoms in the second amorphous layer (II) by varying the flow rate ratio of $SiH_4$ gas:$SiF_4$ gas:$C_2H_4$ gas during formation of the amorphous layer (II). For the thus obtained image forming members, image evaluations were conducted after repeating for 50,000 times the steps of image making, developing and cleaning as described in Example 30 to obtain the results as shown in Table 32.

TABLE 32

| $SiH_4$:$SiF_4$:$C_2H_4$ | 5:4:1 | 3:3.5:3.5 | 2:2:6 | 1:0.7:8.3 | 0.5:0.5:9 |
|---|---|---|---|---|---|
| Si:C (Content ratio) | 9.5:0.5 | 8.7:1.3 | 7:3 | 4.5:5.5 | 2.9:7.1 |
| Evaluation | ○ | ◎ | ○ | Δ | Δ |

◎: Very good
○: Good
Δ: Practically useful, but ground fogging at white ground portion and peel-off of layer from the substrate formed

EXAMPLE 33

Image forming members were prepared according to entirely the same procedure as in Example 30 except for varying the layer thickness of the amorphous layer (II) as shown in Table 33 below. By repeating the image making, developing and cleaning steps as described in Example 30, the following results were obtained.

TABLE 33

| Thickness of amorphous layer (II) (μ) | Results |
|---|---|
| 0.001 | Image defect liable to occur |
| 0.02 | No image defect during 20,000 repetitions |
| 0.05 | Stable for 50,000 repetitions or more |
| 1 | Stable for 200,000 repetitions or more |

EXAMPLE 34

An image forming member was prepared according to the same procedure as in Example 30 except for changing the methods for forming the layers other than the amorphous layer (II) to those as shown in the Table 34 below, and evaluation was conducted similarly as in Example 30 to obtain good results.

TABLE 34

| Order of layer formation | Conditions: Gases employed | Flow rate (SCCM) | Flow rate ratio | Discharging power (W/cm$^2$) | Layer thickness |
|---|---|---|---|---|---|
| 1 (Lower interface layer) | $SiH_4$/He = 1 $NH_3$ | $SiH_4$ = 100 | $SiH_4$:$NH_3$ = 1:30 | 0.18 | 500 Å |
| 2 (Rectifying layer) | $SiH_4$/He = 1 $PH_3$/He = $10^{-2}$ | $SiH_4$ = 200 | $SiH_4$:$PH_3$ = 1:3 × $10^{-3}$ | 0.18 | 6000 Å |
| 3 (Upper interface layer) | $SiH_4$/He = 1 $NH_3$ | $SiH_4$ = 10 | $SiH_4$:$NH_3$ = 1:30 | 0.18 | 500 Å |
| 4 (Amorphous layer (I)) | $SiH_4$/He = 1 | $SiH_4$ = 200 | | 0.18 | 15μ |

EXAMPLE 35

An image forming member was prepared according to the same procedure as in Example 30 except for changing the methods for forming the layers other than the amorphous layer (II) to those as shown in the Table 35 below, and evaluation was conducted similarly as in Example 30 to obtain good results.

TABLE 35

| Order of layer formation | Conditions: Gases employed | Flow rate (SCCM) | Flow rate ratio | Discharging power (W/cm$^2$) | Layer thickness |
|---|---|---|---|---|---|
| 1 (Interface layer) | $SiH_4$/He = 1 $NH_3$ | $SiH_4$ = 100 | $SiH_4$:$NH_3$ = 1:30 | 0.18 | 400 Å |
| 2 (Rectifying layer) | $SiH_4$/He = 1 $SiF_4$/He = 1 $PH_3$/He = $10^{-2}$ | $SiH_4$ = 100 | $SiH_4$:$SiF_4$:$PH_3$ = 1:1:5 × $10^{-4}$ | 0.18 | 8000 Å |
| 3 (Amorphous layer (I)) | $SiH_4$/He = 1 $SiF_4$/He = 1 | $SiH_4$ = 100 | $SiH_4$:$SiF_4$ = 1:1 | 0.18 | 15μ |

EXAMPLE 36

An image forming member was prepared according to the same procedure as described in Example 32 except that the amorphous layer (II) was prepared according to the sputtering method under the conditions shown below in Table 36 and evaluated similarly as in Example 32 to obtain good results.

TABLE 36

| Formed image | Conditions: Gases employed | Flow rate (SCCM) | Target area ratio Si wafer:graphite | Discharging power ($W/cm^2$) | Layer thickness ($\mu$) |
|---|---|---|---|---|---|
| Amorphous layer (II) | Ar<br>$SiF_4/He = 0.5$ | Ar = 200<br>$SiF_4 = 100$ | 3:1 | 0.3 | 1 |

EXAMPLE 37

Examples 30, 31, 34 and 35 were repeated except that the conditions for formation of the amorphous layer (I) were changed to those as shown in Table 37, and the image forming members thus prepared were evaluated similarly as in respective Examples to obtain good results.

TABLE 37

| Formed image | Conditions: Gases employed | Flow rate (SCCM) | Flow rate ratio | Discharging power ($W/cm^2$) | Layer thickness ($\mu$) |
|---|---|---|---|---|---|
| Amorphous layer (I) | $SiH_4/He = 1$<br>$B_2H_6/He = 10^{-2}$ | $SiH_4 = 200$ | $SiH_4:B_2H_6 = 1:2 \times 10^{-5}$ | 0.18 | 15 |

We claim:

1. A photoconductive member, comprising a support for a photoconductive member, an interface layer comprising an amorphous material containing silicon atoms and nitrogen atoms as constituent atoms, a rectifying layer comprising an amorphous material containing atoms (A) belonging to the group III or the group V of the periodic table as constituent atoms in a matrix of silicon atoms, a first amorphous layer exhibiting photoconductivity and comprising an amorphous material containing at least one member selected from the group consisting of hydrogen atoms and halogen atoms as constituent atoms in a matrix of silicon atoms, and a second amorphous layer containing an amorphous material represented by any of the formulas:

$$Si_aC_{1-a}(0.4<a<1) \quad (1)$$

$$(Si_bC_{1-b})_cH_{1-c}(0.5<b<1,\ 0.6\leqq c<1) \quad (2)$$

$$(Si_dC_{1-d})_eX_{1-e}(0.47<d<1,\ 0.8\leqq e<1) \quad (3)$$

$$(Si_fC_{1-f})_g(H+X)_{1-g}(0.47<f<1,\ 0.8\leqq g<1) \quad (4)$$

wherein X represents a halogen atom.

2. A photoconductive member according to claim 1, wherein the amorphous material contained in the interface layer contains further hydrogen atoms.

3. A photoconductive member according to claim 1, wherein the amorphous material contained in the interface layer contains further halogen atoms.

4. A photoconductive member according to claim 1, wherein the amorphous material contained in the interface layer contains further hydrogen atoms and halogen atoms.

5. A photoconductive member according to claim 1, further having a second interface layer comprising an amorphous material containing silicon atoms and nitrogen atoms as constituent atoms between the rectifying layer and the first amorphous layer.

6. A photoconductive member according to claim 1, wherein the interface layer has a thickness of 30Å to 2$\mu$.

7. A photoconductive member according to claim 1, wherein the rectifying layer has a thickness of 0.3 to 5$\mu$.

8. A photoconductive member according to claim 1, wherein the first amorphous layer has a thickness of 1 to 100$\mu$.

9. A photoconductive member according to claim 1, wherein the second amorphous layer has a thickness of 0.003 to 30$\mu$.

10. A photoconductive member according to claim 1, wherein the content of atoms (A) in the rectifying layer is $1\times10^2$ to $1\times10^5$ atomic ppm.

11. A photoconductive member according to claim 1, wherein the content of hydrogen atoms in the first amorphous layer is 1 to 40 atomic %.

12. A photoconductive member according to claim 1, wherein the content of halogen atoms in the first amorphous layer is 1 to 40 atomic %.

13. A photoconductive member according to claim 1, wherein the total content of hydrogen atoms and halogen atoms in the first amorphous layer is 1 to 40 atomic %.

* * * * *

UNITED STATES PATENT AND TRADEMARK OFFICE

CERTIFICATE OF CORRECTION

PATENT NO. : 4,452,875

DATED : June 5, 1984

INVENTOR(S) : OGAWA, ET AL.

It is certified that error appears in the above-identified patent and that said Letters Patent is hereby corrected as shown below:

Col. 4, line 14, "layers" should be --layer--.
Col. 11, line 6, "flow" should be --glow--.
Col. 22, Table 5, In row 2, Col. 2, "$B_2H/He = 10^{-2}$" should be --$B_2H_6/He = 10^{-2}$--.
Col. 38, Table 31, In row 2, Column heading Flow rate ratio, "$SiH_4:PH_3 = 1:1 \times 10^{-1}$" should be --$SiH_4:PH_3 = 1:1 \times 10^{-3}$--

Signed and Sealed this

*Eleventh* Day of *December 1984*

[SEAL]

*Attest:*

GERALD J. MOSSINGHOFF

*Attesting Officer* *Commissioner of Patents and Trademarks*